United States Patent [19]

Wride

[11] Patent Number: 4,901,684

[45] Date of Patent: Feb. 20, 1990

[54] VARIABLE LIFT CAM FOLLOWER

[75] Inventor: Donald C. Wride, Valley View, Australia

[73] Assignee: Marlene Alfreda Wride, Valley View, Australia

[21] Appl. No.: 269,615

[22] Filed: Nov. 10, 1988

[51] Int. Cl.[4] ..... F01L 1/34

[52] U.S. Cl. ..... 123/90.16; 123/90.12

[58] Field of Search ..... 123/90.12, 90.13, 90.16, 123/90.48

[56] References Cited

U.S. PATENT DOCUMENTS

| | | | |
|---|---|---|---|
| 2,565,022 | 8/1951 | Hattink | 123/90.16 |
| 2,936,575 | 5/1960 | Lieberherr | 123/90.16 |
| 3,405,699 | 10/1968 | Laas | 123/90.12 |
| 4,153,016 | 5/1979 | Hausknecht | 123/90.12 |
| 4,278,233 | 7/1981 | Zurner et al. | 123/90.12 |
| 4,502,426 | 3/1985 | Skelley | 123/90.16 |
| 4,592,319 | 6/1986 | Meistrick | 123/90.12 |
| 4,664,070 | 5/1987 | Meistrick et al. | 123/90.13 |

FOREIGN PATENT DOCUMENTS

| | | | |
|---|---|---|---|
| 0006659 | of 1909 | United Kingdom | 123/90.16 |

*Primary Examiner*—Charles J. Myhre
*Assistant Examiner*—Weilun Lo
*Attorney, Agent, or Firm*—Cushman, Darby & Cushman

[57] ABSTRACT

A mechanism to vary the lift of a valve of an internal combustion engine, the valve being operated by a cam lobe on a cam shaft. A lever is pivoted to a support rotatable about the cam shaft, the cam lobe acting on a shaped bearing area on the lever, the other side of the lever contacting the cam follower, so that by rotation of the support the timing of lift of the valve can be varied. Provision is also made for varying the degree of lift independently of the timing by means of a further lever pivoted to a sleeve rotatable about the cam shaft, the further lever contacting the first lever on one side and the cam follower on the other side. Rotation of the sleeve causes the effective lever arm of the first lever to be varied and thereby the degree of lift of the valve.

6 Claims, 4 Drawing Sheets

VARIABLE LIFT CAM FOLLOWER

This invention relates to an improved variable lift cam follower.

BACKGROUND OF THE INVENTION

In patent application No. PCT/AU83/00003 there is described a mechanism for varying the valve timing an duration of lift of the valves of the internal combustion engine, the engine having a cam shaft and hydraulic cam followers, characterized in that the bleed of hydraulic oil from the hydraulic cam follower is controlled through a secondary cam follower, the secondary cam follower operating in a housing adjustably rotatable about a secondary cam shaft. In an embodiment described in that specification the secondary cam shaft actuates the secondary cam follower through an intermediate lever which is pivoted to the housing about the secondary cam follower, this lever then being shaped to give a reduced lift to the secondary cam follower by virtue of the secondary cam follower being in contact with the lever between its pivot point and the point at which the cam operates.

SUMMARY OF THE INVENTION

It is an object of this invention to provide an improved arrangement whereby the lift and timing of a valve can be varied as desired.

In accordance with this invention there is provided a mechanism for varying the lift of the valve of an internal combustion engine, the valve being operated by a cam lobe on a cam shaft, said mechanism including a lever pivoted to a support rotatable about the cam shaft, one side of said lever bearing on the cam lobe, means on the opposite side of said lever adapted to actuate said valve, and means to rotate said support about said cam shaft to vary the timing of lift of the lever and thus of the valve.

In accordance with the invention also the inner housing of the cam follower is adapted to be rotated about the cam shaft so that by angularly varying the housing the lift of the valve can be varied.

BRIEF DESCRIPTION OF THE DRAWINGS

In order to more fully describe the invention, reference will now be made to the accompanying drawings in which.

DESCRIPTION OF THE PREFERRED EMBODIMENT

Figure 1:
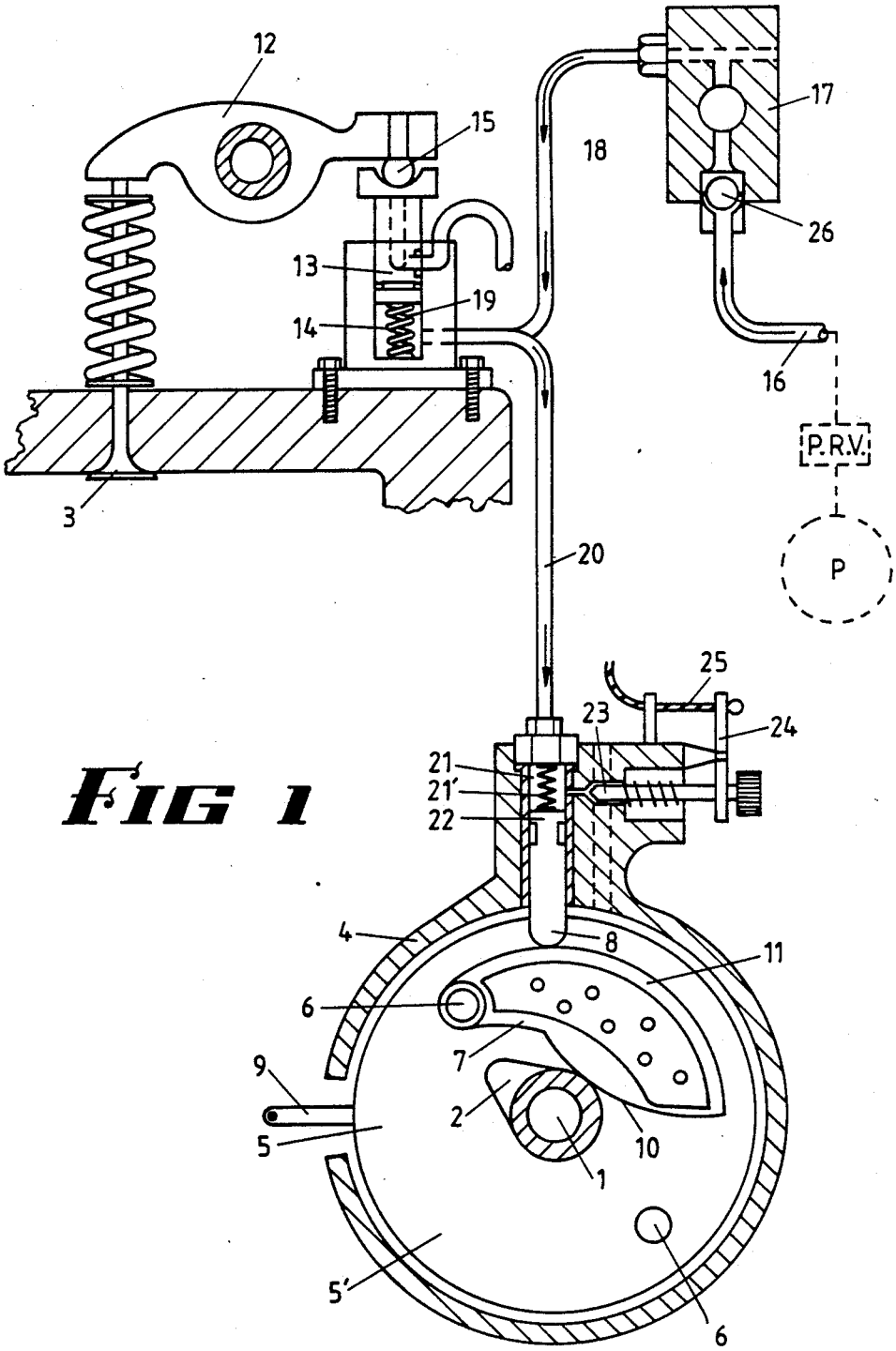
FIG. 1 is a view of one form of the invention.

In a preferred form of the invention, the cam shaft 1 will be provided with the corresponding number of cam lobes 2 for the intake and exhaust valves 3 (only one of which is shown) of the internal combustion engine, the cam shaft operating in a housing 4. The housing 4 includes end plates 5 which are rotatable in the housing 4 about the cam shaft 1, a plurality of intermediate plates 5' being mounted in the housing, these intermediate plates being spaced intermediate the adjacent cam lobes 2. The plates 5, 5' are connected by a pair of diametrically opposed shafts 6 to support and add stability to the assembly to allow movement to be rigid and accurate, one of the shafts 6 having pivoted thereon cam levers 7 acting between the cam lobes 2 and the cam follower 8. A lever 9 is attached to one of the plates 5 so that the plates may be rotated about the cam shaft 1 so that in this way the timing of the opening of the inlet and exhaust valves of the engine can be varied.

The cam levers 7 can be of any desired shape, having a bearing area 10 to bear on the cam lobe 2, the body of the lever preferably being a thin flange like construction which can be lightened by the incorporation of holes therein, with the upper bearing surface 11 for the cam follower 8 being in the form of a flange or the like. The contour of the upper surface 11 is curved and is ground concentric with the cam shaft 1. The plates 5 are rotatable about the cam shaft with the cam levers contacting and moving relative to the cam shaft 1, and each cam lever 7 has the bearing surface 11 extended for contact with the cam follower.

As shown in FIG. 1, the valve 3 is operated by a rocker arm 12 which is actuated by a hydraulic piston 13, a spring 14 maintaining the piston 13 against a bearing member 15 on the rocker 12.

Hydraulic fluid is supplied through line 16 from a pump and pressure relief valve through a manifold block 17 which distributes fluid to all the valves of the engine, a line 18 connecting the manifold block to the piston chamber 19.

Line 20 connects the piston chamber 19 to the bore 21 in housing 4 in which the cam follower 8 moves, the cam follower at its inner end forming a cam follower piston 22, a spring 23' acting on the piston 22 to maintain contact of the follower 8 with the lever 7.

An adjustable bleed valve 23 connects to the bore 21, the bleed valve being adjustable by lever 24 and control member 25 and a one way valve 26 is provided on the inlet to the block 17, and a further one way valve (not shown) is provided in the outlet of the block.

Figure 4:
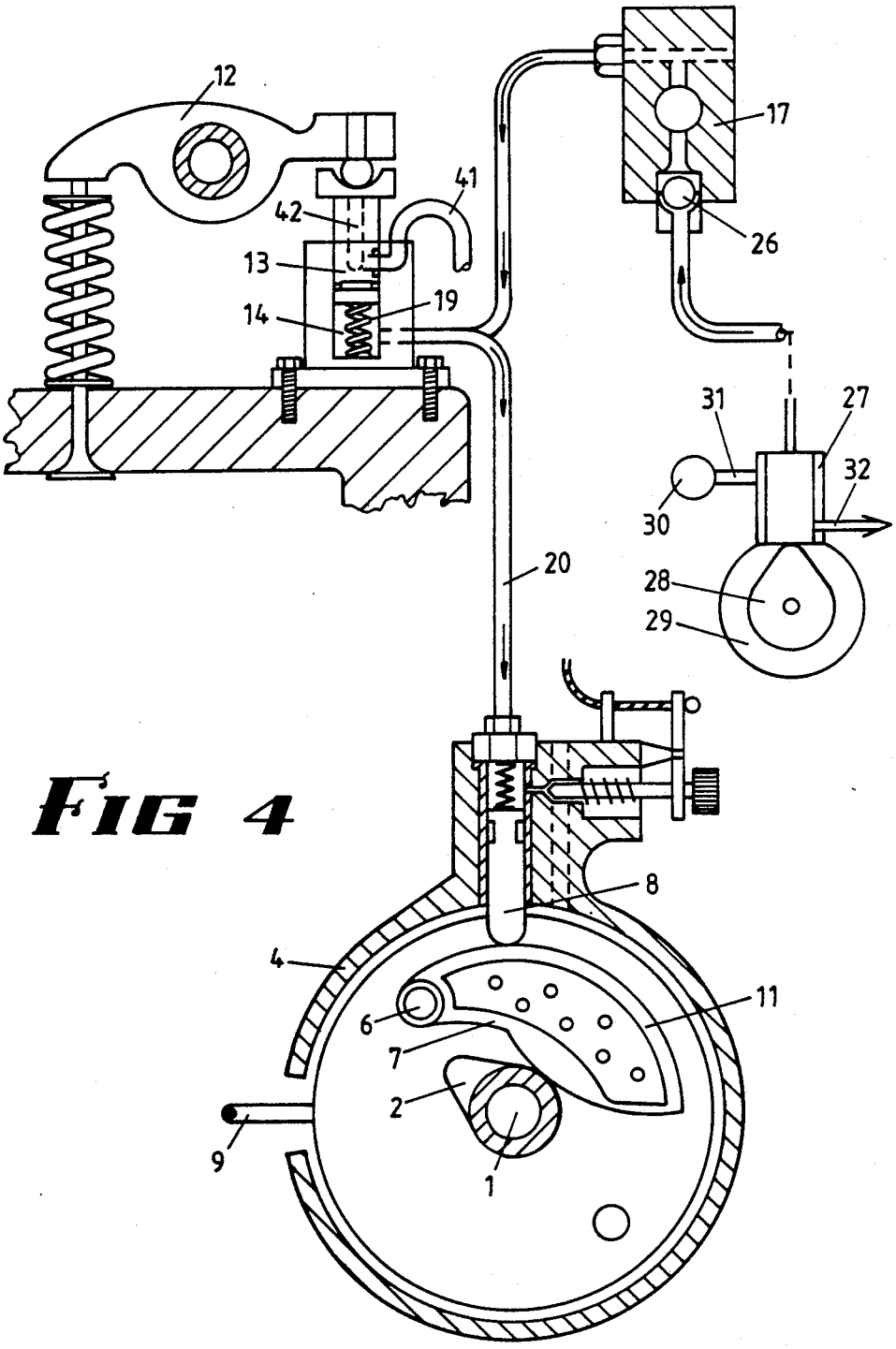
FIG. 4 is a further alternative.

In a further alternative as shown in FIG. 4, the supply of pressure fluid to line 16 can be provided by a further cam follower 27 operated by a further cam lobe 28 on a further cam shaft 29, and supplied by a pump 30 through line 31, and having a bleed line 32. Thus the pressure impulse by the further cam follower 27 is controlled and modified by the first cam follower to either increase the lift or vary the timing as desired.

Figure 2:
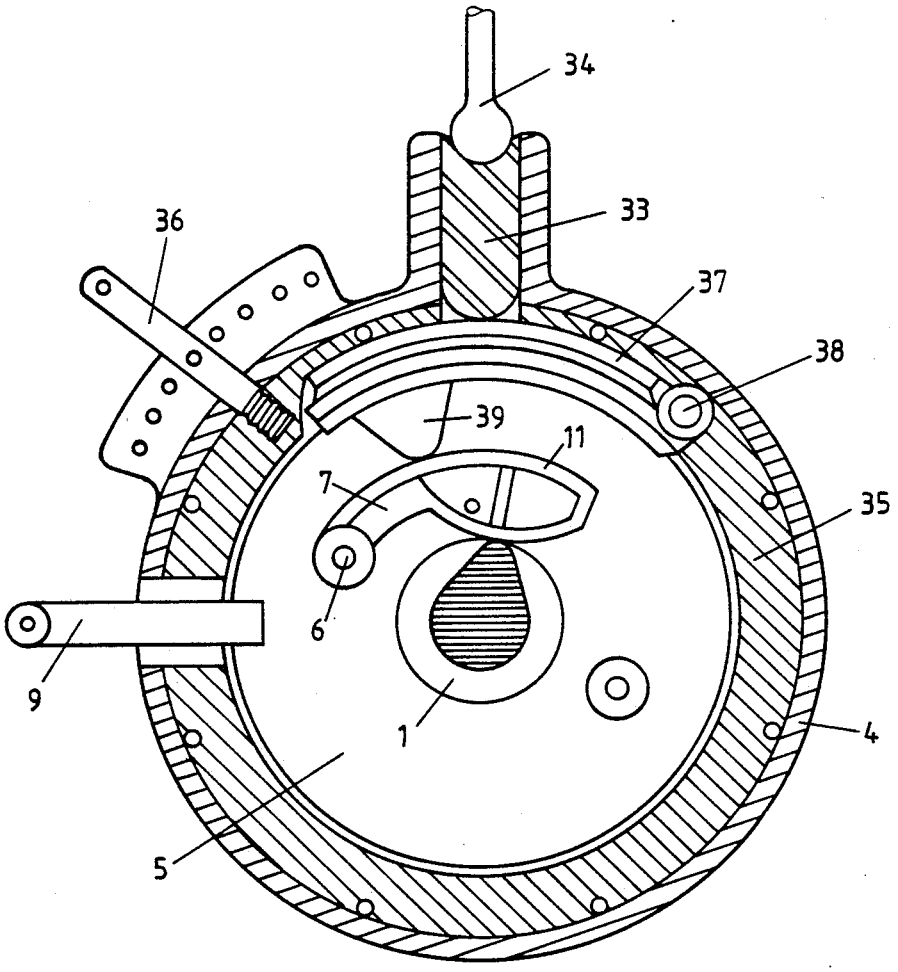
FIG. 2 is a second embodiment.
Figure 3:
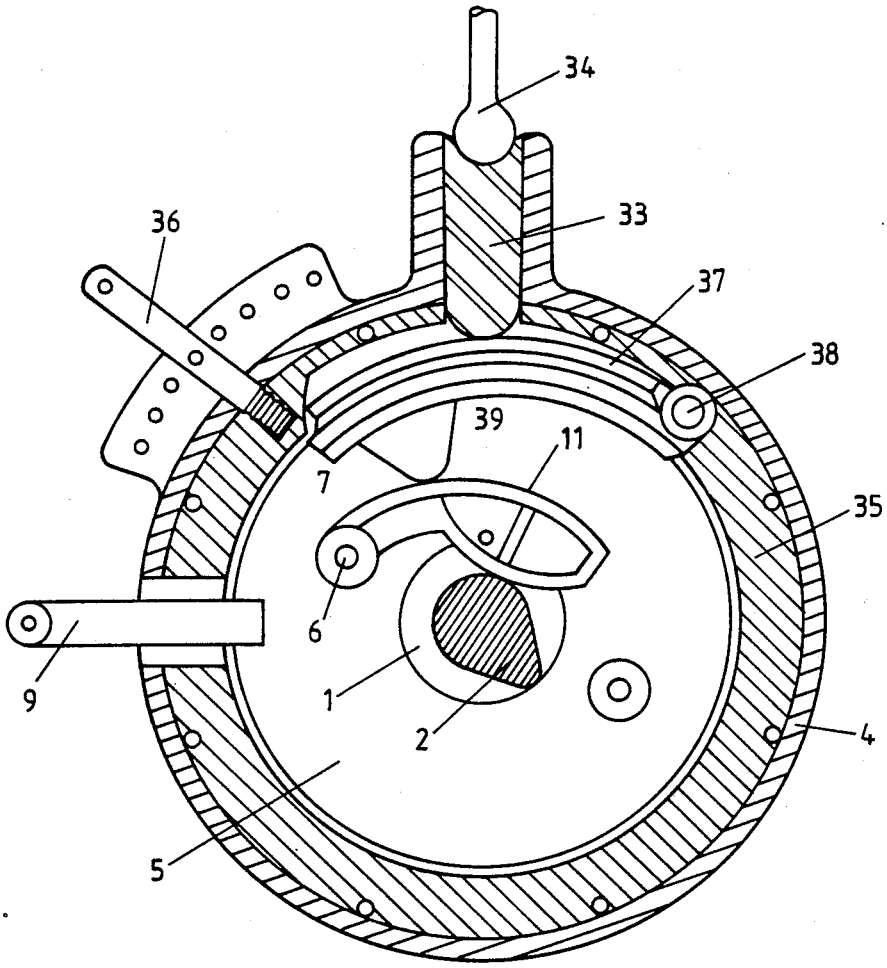
FIG. 3 is a further view of FIG. 2.

FIGS. 2 and 3 illustrate a further embodiment of the invention wherein the degree of lift of the opening of the valve can be varied, i.e., to give a greater opening of the valve, and which can be mechanically operated or have a hydraulic lift as in FIG. 1. As shown the lift is mechanical through a cam follower 33 actuating a push rod 34. This cam follower can be a mechanical follower or a hydraulic cam follower.

Inside the casing 4 there is provided a rotatable sleeve 35 actuated by a control lever 36, the sleeve 35 having pivoted thereto a follower lever 37 by a pivot pin 38. The cam follower 33 bears on a follower lever 37, the follower lever 37 having a contact abutment 39 which bears on the cam lever 7. Thus, it will be seen that by adjustment of the sleeve 35, the effective lever arm of the cam lever 7 is varied, from a short lever arm to give a small lift to a large lever arm to give a larger lift to the valve, without varying the timing of the valve lift. Thus, as shown in FIGS. 2 and 3, there is provision for varying the timing of the lift by adjustment of position of the cam lever 7, or the degree of lift by adjustment of the position of the follower lever 37, there is provision for varying the timing of the lift by adjustment of position of the cam lever 7, or the degree of lift by adjustment of the position of the follower lever 37. FIGS. 2 and 3 show the operation of the two levers in two positions of the cam shaft 1.

In FIGS. 1 and 4, means are provided for the lubrication of the rocker assembly 12, this including a lubrication line 41 connected to the through passage 42.

The control for the timing of the opening of the valves by virtue of the end plates 5 can be any desired mechanism for turning the end plates, preferably these could be provided with a gear or the like on each end plate, a shaft with co-operation gear wheels inter-connecting the end plates so that they move simultaneously. A further gear on the inter-connecting shaft can thus be actuated by any suitable control mechanism.

The control for varying the angularity of the sleeve can be as desired, preferably by a lever arrangement. All mechanisms return to preset positive location for idle either by using a spring tensioned mechanism or a powered source.

The various of the two controls can be manual, or can be automatic dependent upon the speed and load requirements on the engine either hydraulically, pneumatically or electrically, or can be part automatic and part manual so that the driver can select himself the control for either economy or performance.

Also, it is within the concept of the invention that the control can be computerised so that this is fully automatic depending upon the speed, throttle opening, load and other operating parameters of the engine.

In a still further embodiment, the invention can be bolted to the head of the engine, there being a direct mechanical action between the cam shaft and the valve stem 51. The cam lobe 51 is of flattened form to have a flat extended contact area to thus produce a longer duration of valve opening. The cam lobe contacts the cam lever pivoted to a plate which is controllable by a lever. The cam lever bears on a lobe of a follower lever which is pivoted to a sleeve that is slidable in a housing. The sleeve is rotatable by a lever.

The follower lever bears on a tappet having an adjustment to contact the valve stem having a usual spring retained by a collet.

The unit can be bolted to the head of the engine, and one unit and the cam shaft can be utilised by the inlet valves, and a second unit and cam shaft for the outlet valves, in effect the invention can thus be applied to a twin overhead cam shaft engine. Hence either or both of the sets of valves can be individually controlled, and in effect by controlling the inlet valves, speed variation can be obtained without recourse to varying the flow of the fuel/air mixture by a carburettor. Hence a constant fuel mixture can be delivered to the inlet valves eliminating the high vacuum in the inlet valve manifold which would be created by a carburettor, the speed control being by the adjustment of the inlet valves by the duration and timing of opening only.

In all of the embodiments of the invention, it will be realised that the sleeves, plates, rings and levers all have concentric movement about the cam shaft when the levers contact the concentric surface of the cam shaft and when the levers are pushed inward to the center.

Also, with this invention, while it is possible to vary the inlet and exhaust valves of each of the cylinders simultaneously, it is within the concept of this invention to vary selected ones on the inlet valves so that a group of valves for a particular group of pistons and cylinders may be rendered ineffective while the engine continues to run on the remaining cylinders. Thus it is possible to render ineffective various cylinders, such as two or three or four cylinders from six or eight cylinder engines so that the valves are then effectively held open all the time or closed all the time as desired so that the engine would then operate on a reduced number of cylinders at low loads.

In an alternative arrangement, each of the cam levers can be mounted on an independent spacer mounted in the housing, so that each cam lever can be moved independently of the other as desired, or alternatively a mechanism can be provided externally of the housing inter-connecting each of the independent spacers controlling the cam levers.

It will be seen by the invention, that the further cam shaft is used to control or modify the action produced by the first cam shaft. The first cam follower operates as a conventional solid cam follower with a heat expansion gap. The first cam follower has a closed hydraulic cylinder connected hydraulically to the further valve lifter. If the further valve lifter fails the engine will operate by virtue of the first cam shaft and cam follower. Even if the further system loses efficiency, the engine will operate without causing undue problems.

The invention also can be applied to engines when the hydraulic cam followers are provided on the cylinder head, and is supplemental to engines operating by push rods.

Although various forms of the invention have been described in some detail, it is to be realised that the invention is not to be limited thereto but can include various modifications falling within the spirit and scope of the invention.

I claim:

1. A mechanism for varying the lift of the valve of an internal combustion engine, the valve being operated by a cam lobe on a cam shaft, said mechanism including:

a lever pivoted to a support rotatable about the cam shaft, one side of said lever bearing on the cam lobe, means on the opposite side of said lever adapted to actuate said valve, and means to rotate said support about said cam shaft to vary the timing of lift of the lever and thus of the valve, said means on the opposite side of said lever including a further lever pivoted to a sleeve rotatable about said cam shaft and contacting said first lever, said further lever actuating a cam follower to actuate said valve, whereby, on rotation of said sleeve, the effective lever arm of said first lever is varied to vary the degree of lift of said cam follower and, hence, of said valve.

2. A mechanism as defined in claim 1, wherein the means on the opposite side of said lever is a mechanical cam follower actuating a push rod to operate said valve.

3. A mechanism as defined in claim 1, wherein the means on the opposite side of said lever is a hydraulic cam follower.

4. A mechanism as defined in claim 3, wherein said hydraulic cam follower has a piston operating in a chamber, a hydraulic line connecting said chamber to a further piston connected by a linkage to operate said valve.

5. A mechanism for varying the lift of the valve of an internal combustion engine, the valve being operated by a cam lobe on a cam shaft, said mechanism including:

a lever pivoted to a support rotatable about the cam shaft, one side of said lever bearing on the cam lobe, means on the opposite side of said lever adapted to actuate said valve, and means to rotate said support about said cam shaft to vary the timing of lift of the lever and thus of the valve, the means on the opposite side of said lever being a hydraulic cam follower, said hydraulic cam follower having a piston operating in a chamber, a hydraulic line connecting said chamber to a further piston connected by a linkage to operate said valve, the hydraulic fluid being supplied from a pump through a further hydraulic cam follower, and a bleed on the first hydraulic cam follower, whereby adjustment of the action of the first hydraulic cam follower modifies the timing and lift of the further hydraulic cam follower.

6. A mechanism for varying the lift of the valve of an internal combustion engine, the valve being operated by a cam lobe on a cam shaft, said mechanism including:

a lever pivoted to a support rotatable about the cam shaft, one side of said lever bearing on the cam lobe, means on the opposite side of said lever adapted to actuate said valve, and means to rotate said support about said cam shaft to vary the timing of lift of the lever and thus of the valve, the means on the opposite side of said lever being a hydraulic cam follower, said hydraulic cam follower having a piston operating in a chamber, a hydraulic line connecting said chamber to a further piston connected by a linkage to operate said valve, the hydraulic fluid being supplied from a pump through a pressure relief valve to a distribution block, a non-return valve preventing return of fluid, a line connecting the distribution block to the said further piston and an adjustable relief valve regulating bleed from the hydraulic cam follower.

* * * * *